US007449216B2

(12) United States Patent
Lobo et al.

(10) Patent No.: US 7,449,216 B2
(45) Date of Patent: Nov. 11, 2008

(54) GRAVURE CYLINDER PATCH COATING APPARATUS AND METHOD

(75) Inventors: Rukmini B. Lobo, Rochester, NY (US); James P. Heetderks, Webster, NY (US); David A. Wakefield, Canandaigua, NY (US); Roger D. Beam, Albion, NY (US); Mikel S. Hill, Honeoye Falls, NY (US); Alan R. Bentz, Bergen, NY (US); Charles S. Christ, Rochester, NY (US); Ralph P. Schultz, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 482 days.

(21) Appl. No.: 10/988,242

(22) Filed: Nov. 12, 2004

(65) Prior Publication Data

US 2006/0105108 A1 May 18, 2006

(51) Int. Cl.
*B05D 1/26* (2006.01)

(52) U.S. Cl. ..... 427/256; 427/288; 427/428.06

(58) Field of Classification Search ..... None
See application file for complete search history.

(56) References Cited

U.S. PATENT DOCUMENTS

| | | | | |
|---|---|---|---|---|
| 1,096,483 | A | | 5/1914 | Wood |
| 1,600,487 | A | | 9/1926 | Roehlen |
| 1,749,960 | A | | 11/1930 | Kratz |
| 2,076,203 | A | | 4/1937 | Mailander |
| 2,700,629 | A | | 1/1955 | Townsend |
| 3,397,319 | A | | 8/1968 | De Ligt |
| 3,468,700 | A | * | 9/1969 | Long ..... 427/128 |
| 3,762,319 | A | | 10/1973 | Gazzola et al. |
| 3,936,549 | A | | 2/1976 | Kohler et al. |
| 4,057,864 | A | | 11/1977 | Wild |
| 4,077,317 | A | | 3/1978 | Kiesewetter et al. |
| 4,147,126 | A | * | 4/1979 | Riggs ..... 118/227 |
| 4,305,332 | A | | 12/1981 | Pfahl et al. |
| 4,373,443 | A | | 2/1983 | Matalia et al. |
| 4,774,107 | A | | 9/1988 | Von Kwiatkowski et al. |
| 4,901,641 | A | | 2/1990 | Steiner et al. |
| 4,989,514 | A | | 2/1991 | Schiavi |

(Continued)

FOREIGN PATENT DOCUMENTS

| | | |
|---|---|---|
| EP | 0 646 458 | 4/1995 |

(Continued)

OTHER PUBLICATIONS

Japanese Patent Abstract No. 03114564.

*Primary Examiner*—Frederick J Parker
(74) *Attorney, Agent, or Firm*—Andrew J. Anderson; Kathleen Neaner Manne

(57) ABSTRACT

A gravure method for applying a discrete patch (12) of uniform coating to a moving web (14) includes defining a nip area (20) between a gravure roller (16) and a backing roller (22), moving the gravure roller to the nip to a precise lengthwise location on the web, and moving the gravure roller from the nip. The method is improved by controlling the speed of movement of the gravure roller to the nip, and controlling the speed of movement of the gravure roller from the nip thereby producing a discrete patch.

11 Claims, 5 Drawing Sheets

U.S. PATENT DOCUMENTS 5,302,203 A 4/1994 Zimmer
5,426,588 A 6/1995 Walters et al.
5,582,868 A 12/1996 Harada et al.
5,664,306 A 9/1997 Sa'don et al.
5,702,760 A * 12/1997 Kustermann ..... 427/172
6,272,986 B1 8/2001 Hess

FOREIGN PATENT DOCUMENTS

JP 03-114564 A 5/1991

* cited by examiner

GRAVURE CYLINDER PATCH COATING APPARATUS AND METHOD

FIELD OF THE INVENTION

The present invention relates generally to an apparatus and method for coating patches on a moving web by the gravure coating process, and, more particularly, to a method for coating patches of varying lengths onto the web with a single, fixed diameter gravure coating cylinder.

BACKGROUND OF THE INVENTION

Gravure printing and coating methods are well known in the art for applying liquids to webs or sheets. For example, U.S. Pat. No. 4,373,443 discloses a gravure cylinder for providing ink in a newspaper press. Cells or depressions engraved upon the surface of the gravure cylinder are filled to excess with a coating liquid that is used to form an image on the newsprint. Typically, a gravure cylinder rotates in a pan holding a constant level of coating liquid for wetting as taught in U.S. Pat. No. 3,936,549. A doctor blade, made of a metal softer than that of the surface of the gravure cylinder, wipes any excess liquid from the surface of the gravure cylinder so that only the engraved areas hold liquid. The gravure cylinder then delivers a precise amount of liquid to a web or other receiving surface upon contact with the engraved areas. The transfer typically occurs in a nip formed between the gravure cylinder and an impression roller that has an elastomeric cover serving as a backing for the web. The impression roller presses the web against the gravure cylinder to create a small area of contact. Alternatively, the web can be drawn against the gravure cylinder by web tension to create a nip.

U.S. Pat. No. 5,426,588 discloses a method for etching a gravure cylinder with a desired engraved pattern. Japanese Patent Document JP03114564 discloses a continuously etched gravure cylinder without a non-engraved surface area which reduces the doctoring concerns. Patch lengths can be controlled by controlling the cylinder cycling duration and frequency so that it is applying discrete patches at a duration and frequency specific to a given product. It should be possible, therefore, to provide variable patch lengths by cycling a continuously etched gravure cylinder with a desired engraved pattern into and away from the nip between the gravure cylinder containing the coating solution and the substrate to be coated. Cycling can be achieved by various means such as a pickup device or encoder driven signal off the central drive or other suitable drive member, (U.S. Pat. Nos. 3,762,319 and 6,272,986 B1), by following a registration mark printed in the first cylinder or existing on a cylinder (U.S. Pat. No. 1,096,483), or even based purely on time between actuation of sequential cylinders (U.S. Pat. No. 4,305,332). The cyclical spacing of the gravure cylinder engagement thereby facilitates variable patch lengths, not restrained to only those accommodated by a given machine frame. The cyclical timing of the gravure cylinder eliminates the necessity of wiping the gravure cylinder to the meticulous extent required for discontinuous patches without residual contamination in uncoated areas and under or over subsequently coated patches enabling the use of a continuously etched gravure cylinder with a relatively low doctor blade pressure. The cyclical timing driven transition into and out of the coating application required for a patch may take several inches to a foot thereby producing coated waste. The coated waste results in an impractical spool length, which increases manufacturing cost.

Standard practice is to use a precisely engraved patch on the gravure cylinder and subsequently register and progress cylinders to achieve the discrete patches with minimal extra transition lengths. It will be appreciated that it would be highly desirable to have a method for cycling the gravure cylinder that provides transitions equal to the 2 mm transitions currently achieved with standard gravure patch application.

An attempt at such an approach is described in Japanese Patent Document JP 03114564 wherein, while the top side of a continuously running substrate is in a free state, the bottom side is coated by a gravure roll having a engraved area covering entire periphery. Being freed from excess coating material from the surface by a doctor blade, the gravure roll rotates with a peripheral speed in relation to the substrate speed, and is fed with a certain amount of coating material in the engraved part. The substrate is dried. Then, while the top side of the continuously running dried substrate is in a free state, the bottom side is coated by a continuously engraved gravure roll. Being freed from excess coating material from the surface by a doctor blade, the gravure roll rotates with a peripheral speed in relation to the substrate speed, and is fed with a certain amount of a different coating material in the engraved part. The substrate is then dried.

The multicolor gravure coating apparatus has a plurality of combination units of a gravure roll having a diameter of about 20-50 mm, an engraved part covering the entire periphery, and applies a coating material to the bottom part of a continuously running substrate while the top part is in a free state. A doctor blade scrapes off excess coating material from the gravure roll surface to feed a certain amount of coating material to the coating part. A drying part dries the coated material. Each doctor blade-gravure roll combination is installed independently and can be freely moved to and from the bottom of the substrate.

While a continuous substrate is running, by using a number of combinations comprising a gravure roll, doctor blade and drying unit, a number of coating materials of different color can be applied. Namely, in each unit, while the top part of a continuously running substrate is in a free state, a certain amount of coating material is applied to the bottom part of the substrate by a gravure roll of about 20-50 mm in diameter. Metering of this coating material is done by a doctor blade that scrapes off excess coating material from the gravure roll surface. The solid coating formed on the bottom part of the substrate is dried while passed through the drying part. By repeating the coating and drying, multicolor coating is obtained.

Japanese Patent Document JP 03114564 provides an example of a multicolor gravure coating apparatus wherein three sets of coating unit and drying unit combinations are installed in the running direction of continuous substrate for forming coatings of three colors. In the coating unit, the substrate is stretched by two tension rolls and runs horizontally. A gravure roll having engraved part covering entire periphery is located transversely below the middle part of the substrate between the tension rolls. The gravure roll is supported and rotated freely by the bearings supported by a pair of supports that can be moved up and down by an operating mechanism and are installed on a base. Rotating force is transmitted via a coupling from an operating motor. In this example, at the contact point, the gravure roll rotates in a direction opposite to that of the substrate. The outer peripheral surface of the gravure roll has an engraved part that is narrower than the width of the substrate. An overflow receiver is fastened by a bolt to the base below the gravure roll. A coating material feed nozzle that feeds the coating material to the gravure roll is fixed on the overflow receiver. Each coating part unit is installed in such a way that it can be freely moved independently to and from the bottom surface of the substrate by a lifting mechanism.

For achieving good coating by each coating unit to the substrate, speed control rolls are installed upstream and downstream of the coating unit against the running direction of the substrate, and a tension detection sensor is installed further upstream (or downstream, as the case may be) of the speed control roll. This tension detection sensor detects the tension of substrate fed to the coating unit, and each speed control roll controls the running speed of the substrate passing the gravure roll portion of the coating unit according to the tension detected by the tension detection sensor. Each speed control roll is under digital control and rotates at the same speed.

A problem with such a procedure is the inability to achieve the transitions within the tolerances that are achieved with a standard gravure patch application procedure predominantly used to make dye donor ribbon. Smearing can occur whenever there is relative lineal motion between the web and roller at the start or finish of a patch, and a coating line can occur at the finish when the web and gravure roller are separated. These conditions reduce product quality sometimes rendering the product unusable. Accordingly, it will be appreciated that it would be highly desirable to have a method for cycling the gravure cylinder that provides patch coating within the desired transition tolerances. It is also desirable to define the prerequisites for the cycling rate required to provide the transitions with the same accuracy as is delivered by standard gravure patch application methods, and to deliver the requirements to prevent any transients in the initiation or termination of the patch application on to the web. Although the travel speed of the web and gravure roll can be controlled with precision, a problem with smearing and uneven coating persists; so, there is still a need for a method for precisely coating patches on a web without smearing at the transitions.

SUMMARY OF THE INVENTION

The present invention is directed to overcoming one or more of the problems set forth above. According to one aspect of the invention, a method of applying a discrete patch of uniform coating to a moving web, comprises the steps of: delivering a metered amount of coating solution to a continuously etched gravure cylinder; supporting the moving web with a resilient backing roll; controlling linear web movement; defining a nip area between the gravure roller and backing roller; moving the gravure roller to the nip to a precise lengthwise location on the web; controlling the speed of movement, $S_1$, of the gravure roller to the nip; and controlling the speed of movement, $S_2$, of the gravure roller from the nip thereby producing a discrete patch.

The method may include creating additional patches by repeatedly moving gravure roller to and from the nip. The method includes bringing the gravure roller into and maintaining contact with the web by force. $S_1$ and $S_2$ are independent of one another and may be the same value or different values depending on the process parameters. $S_1$ has a magnitude sufficient for creating the patch without smearing the transition, but not sufficient enough to cause rebound. $S_2$ has a magnitude sufficient for creating the patch without smearing the transition, but not sufficient enough to cause an objectionable coating line.

According to another aspect of the invention, a gravure method for applying a discrete patch of uniform coating to a moving web includes defining a nip area between a gravure roller and a backing roller, moving the gravure roller to the nip to a precise lengthwise location on the web, and moving the gravure roller from the nip. The method is improved by controlling the speed of movement, $S_1$, of the gravure roller to the nip; and controlling the speed of movement, $S_2$, of the gravure roller from the nip thereby producing a discrete patch. $S_1$ has a magnitude sufficient for creating the patch without smearing the transition, but not sufficient enough to cause rebound. $S_2$ has a magnitude sufficient for creating the patch without smearing the transition, but not sufficient enough to cause an objectionable coating line.

An apparatus for applying a discrete patch of uniform coating to a moving web, comprises an etched gravure cylinder; means for delivering a metered amount of coating solution to the gravure cylinder; a resilient backing roll supporting the web, the gravure roller and the backing roller defining a nip area therebetween; means for controlling linear movement of the web; means for moving the gravure roller to the nip to a precise lengthwise location on the web; means for controlling speed of movement, $S_1$, of the gravure roller to the nip; and means for controlling speed of movement, $S_2$, of the gravure roller from the nip thereby producing a discrete patch. The apparatus includes means for bringing the gravure roller into and maintaining contact with the web by force. $S_1$ and $S_2$ are independent of one another and may be the same or different depending on the process variables. $S_1$ has a magnitude sufficient for creating the patch without smearing a transition area of the patch, but not sufficient enough to cause rebound of the gravure roller from the web. $S_2$ has a magnitude sufficient for creating the patch without smearing a transition area of the patch, but not sufficient enough to cause an objectionable coating line.

Controlling the travel speed of the gravure roll to and from the web solves the problem of smearing and uneven coating at the transitions.

BRIEF DESCRIPTION OF THE DRAWINGS

The above and other aspects, objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
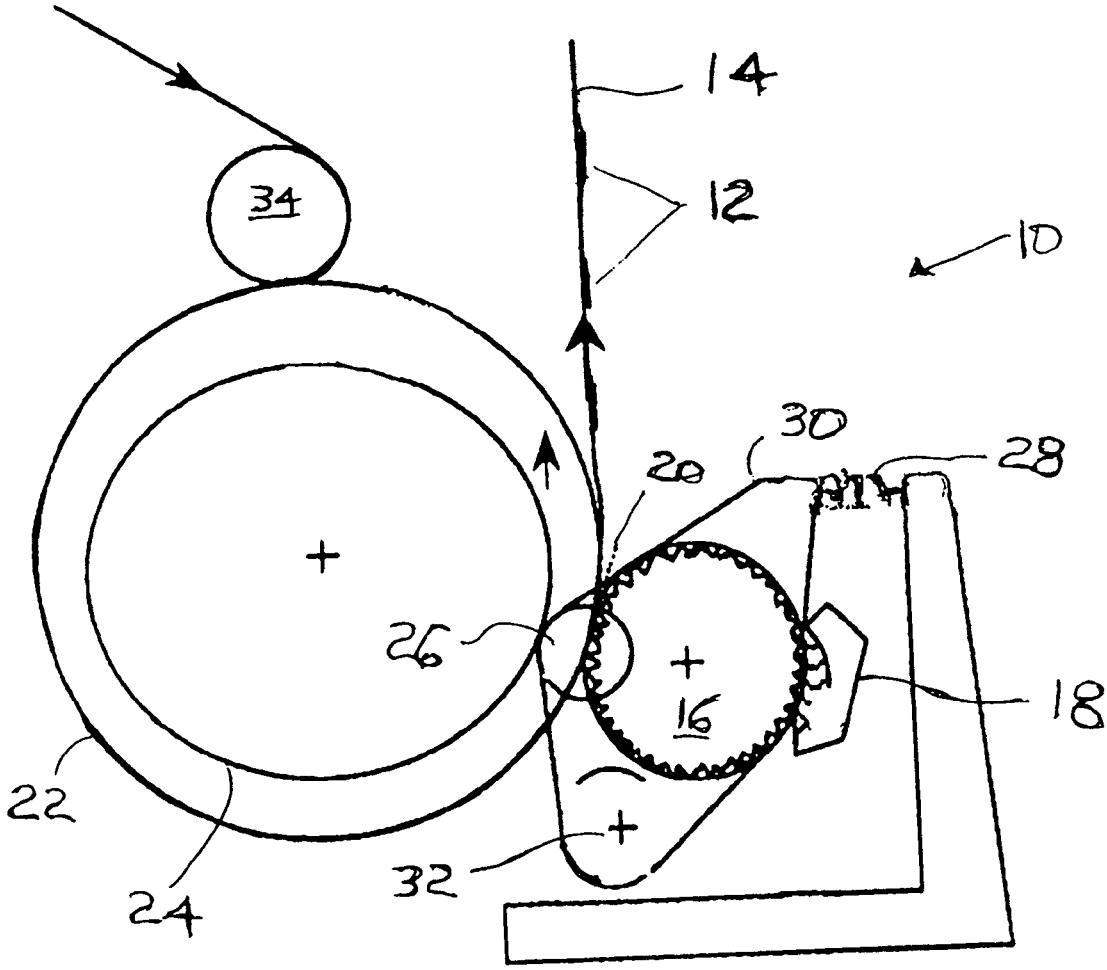
FIG. 1 is a diagrammatic cross section of a gravure apparatus for applying a discrete patch of coating on a moving web using a mechanical cam.

FIG. 1 is a cross section diagram of gravure coating apparatus 10 for applying a discrete patch 12 of coating on a moving web 14 using a continuously engraved gravure cylinder 16. Cells in the gravure cylinder are designed to provide a continuous lateral coating flow for the given solution viscosity by cell compression, wall thickness and channel ratio as described in U.S. Pat. No. 5,426,588. The compression angle coupled with the channel opening, and wall thickness controls the flow laterally for a given coating solution viscosity for a uniform coating. The compression angle may range from 35 degrees to 60 degrees. The compression angle and cell opening is also important in pumping solution in the coating direction to prevent a puddle at the finish of the coating, particularly for low viscosity coating solutions.

The cells of the continuously engraved gravure cylinder 16 are filled by means of an enclosed chamber blade holder 18 containing the coating solution. The gravure cylinder 16 is brought to and from the nip 20 formed between gravure roller 16 and impression roller 22 by an eccentric cam 24 driven off the impression roller 22 and cam follower 26 at eccentric perigee and apogee with a given force provided by an adjustable spring 28. Adjustable spring 28 pushes a pivot arm 30 that pivotally mounts gravure cylinder 16 at the pivot point 32. Variations of patch length are achieved by changing out the eccentric cam 24. The lengthwise displacement of the web during application is controlled by a nip roller 34.

Figure 2:
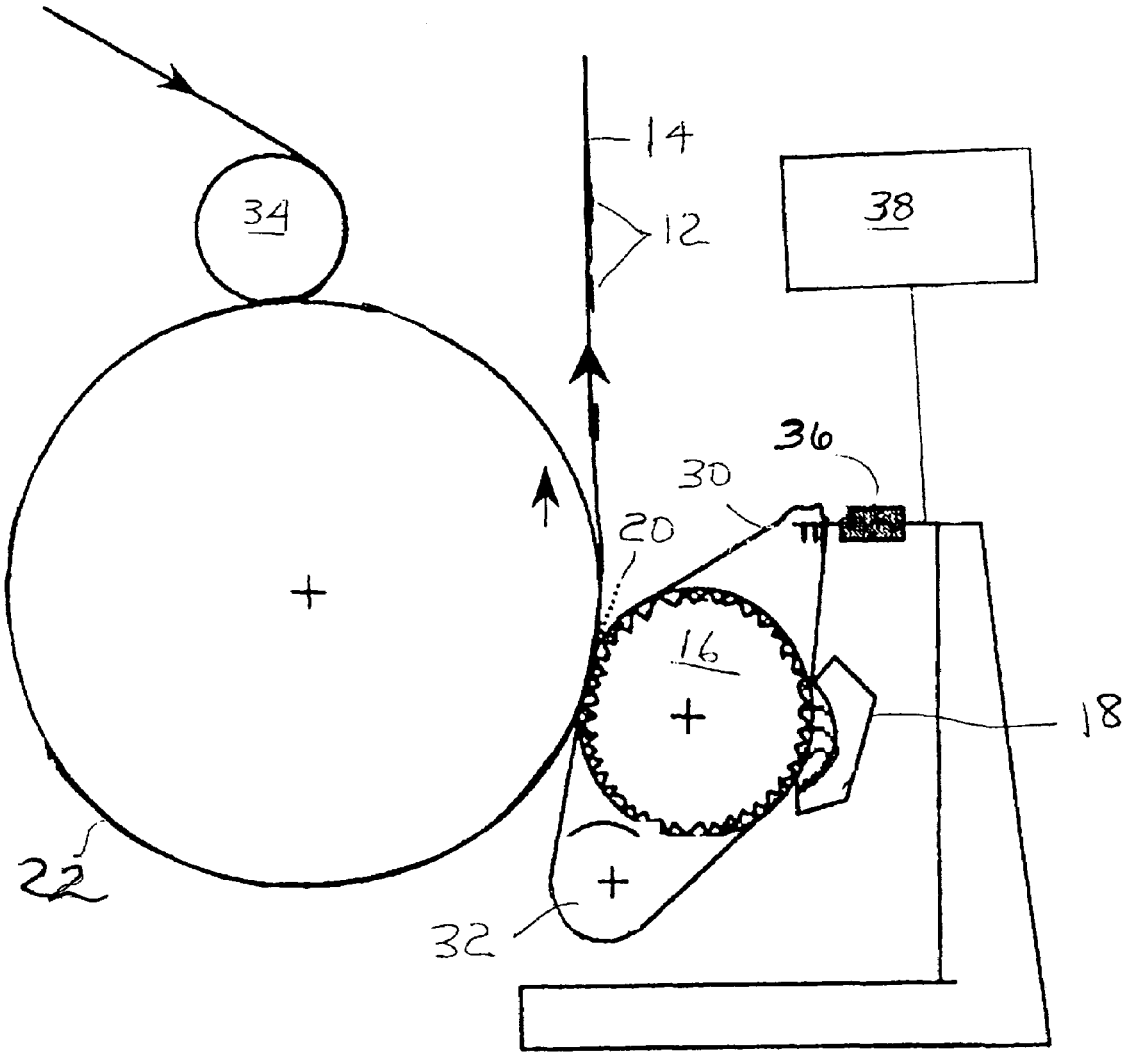
FIG. 2 is a diagrammatic cross section of a gravure apparatus for applying a discrete patch of coating on a moving web using a linear actuator.

FIG. 2 is a cross section of a different embodiment the gravure apparatus 10 where the gravure cylinder 16 is cycled to and from web 14 by an actuator 36, preferably driven by an electronic control 38, and moves the pivot arm 30 to engage and disengage the gravure cylinder.

Figure 3:
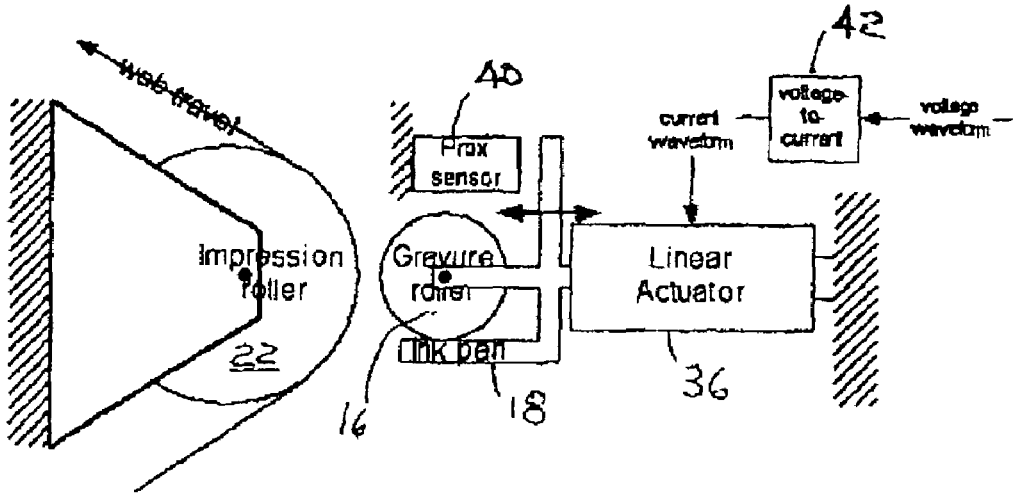
FIG. 3 is a more detailed diagram of the gravure apparatus of FIG. 2 using a linear actuator.

FIG. 3 is a mechanical sketch showing stationary impression roller 22 and movable gravure roller 16 above the ink pan or enclosed chamber blade holder 18. Linear actuator 36 moves gravure roller 16 toward and from impression roller 22. A proximity sensor 40 senses the linear position of gravure roller 16. Linear actuator 36 responds to a current signal from a voltage to current converter 42 so that a specific current implies a specific actuator position.

Figure 4:
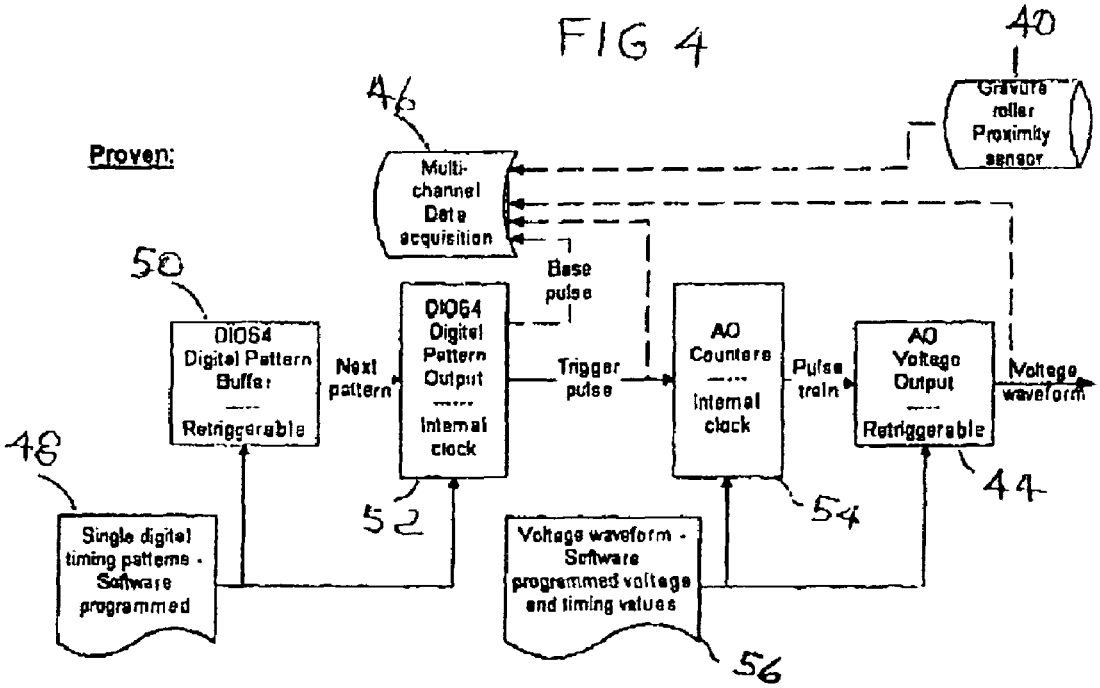
FIG. 4 is schematic block diagram of control apparatus for the linear actuator.

FIG. 4 illustrates control circuitry whose output from analog output module 44 is a voltage waveform that is input to voltage to current converter 42, (as shown in FIG. 3) and to multi-channel data acquisition module 46 along with a signal from proximity sensor 40. Timing patterns are output from single digital timing pattern generator 48, preferably software programmed and input to digital pattern buffer 50 and digital pattern output module 52. Buffer 50 is retriggerable and the output is input to digital pattern output module 52 which has an internal clock. Module 52 provides a base pulse and a trigger pulse to module 46, and provides the trigger pulse to counter 54. Module 54 has an internal clock and receives programmed voltage and timing values (preferably software programmed or from a database) from waveform generator 56. A pulse train from counter 54 is the input for voltage output module 44. The circuitry uses its own time base for data acquisition and does not rely on the encoder pulse train. Module 52 outputs two channels. Channel 0 is the base pulse which is the pulse in/out signal to module 46. Channel 1 is the trigger pulse which is the change of state signal fed to counter 54 as the in and out triggers. The in and out triggers are used by counter 54 to initiate finite N pulse train using it's own two counters (N=2000, frequency=100 KHz) to clock out the counter output.

Figure 5:
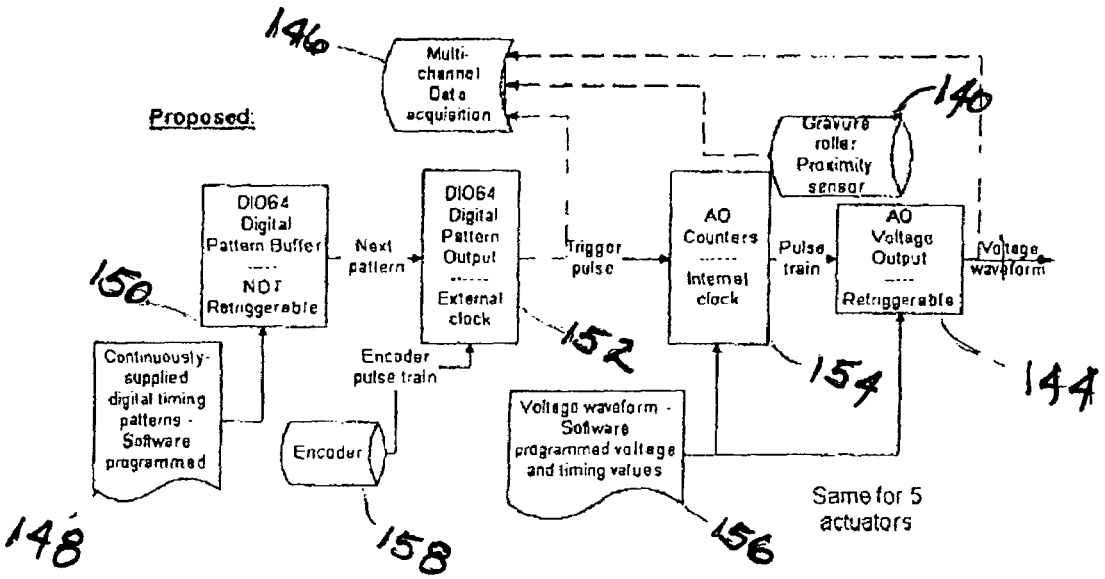
FIG. 5 is schematic block diagram of control apparatus for the linear actuator similar to FIG. 4 but illustrating another preferred embodiment.

FIG. 5 illustrates control circuitry whose output from analog output module 144 is a voltage waveform that is input to voltage to current converter 42, (as shown in FIG. 3) and to multi-channel data acquisition module 146 along with a signal from proximity sensor 140. Continuously supplied digital timing patterns are output from digital timing pattern generator 148, preferably software programmed and input to digital pattern buffer 150. Buffer 150 is non-retriggerable and the output is input to digital pattern output module 152. Module 152 provides a trigger pulse to module 146 and to counter 154. Module 154 has an internal clock and receives programmed voltage and timing values from waveform generator 156 (preferably software programmed or from a database). A pulse train from counter 154 is the input for voltage output module 144. Digital pattern buffer 150 is not configured to be retriggerable; instead, it is loaded with patterns on the fly to keep the registration control system actively controlling the voltage waveforms. The digital pattern output is not clocked internally, but is clocked externally by a signal from encoder 158.

Figure 6:
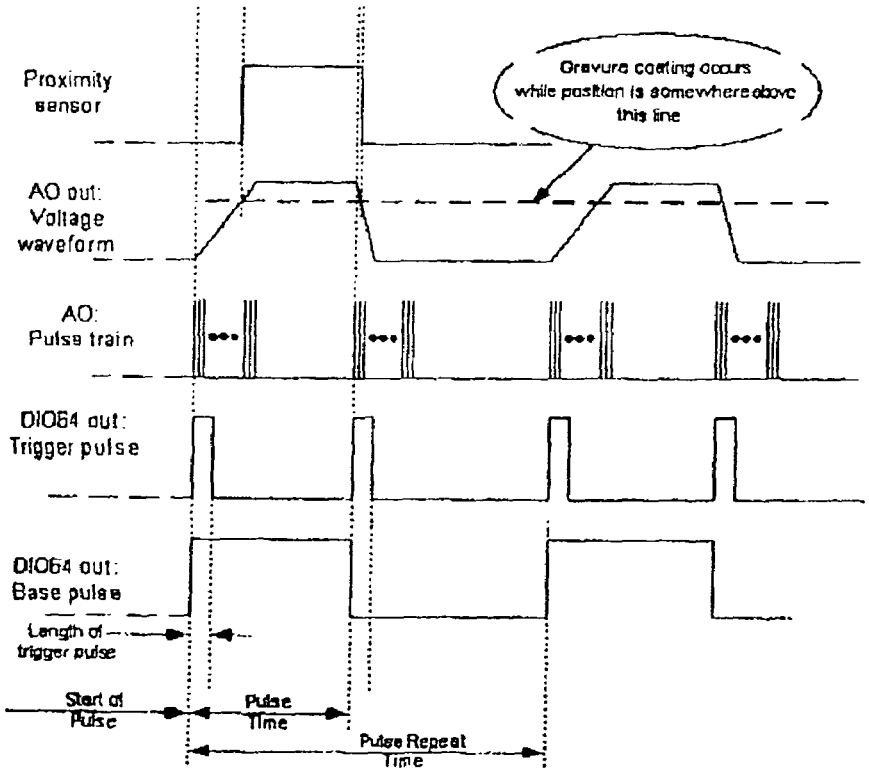
FIG. 6 is a timing diagram for the control apparatus.

FIG. 6 is a timing diagram showing the signal from proximity sensor 158 and voltage waveform from voltage output module 144. A dashed line indicates that gravure coating occurs while voltage is above the dashed line coinciding with a pulse from the proximity sensor. The pulse train occurs while the voltage wave form is rising or falling. The voltage waveform begins following a trigger pulse by rising and falling at the beginning of the next trigger pulse. The base pulse begins with the trigger pulse and lasts until the next trigger pulse.

The present invention provides a means for producing a variable length of patch coating at a variable repeat length employing a single continuously etched gravure cylinder. Ribbons of multiple patch elements are generated by having multiple stations on a web conveyed through a machine or by having a single station and feeding the web through multiple times. The present invention employs a continuously etched gravure cylinder, a means for feeding solution to the cylinder, a means for scraping off solution in excess of the engraving and a means for controlling the engagement and disengagement of the cylinder with the web. The gravure cylinder is brought into contact with the web supported by an elastomeric impression roll to discretely coat the web with coating solution and form the discrete patches.

The location, length and duration of contact between the gravure roller and the web is controlled by the actuator to engage or disengage the gravure cylinder from the coating nip to provide the desired patch and repeat length. The tension in the web with the engagement and disengagement of the gravure cylinder is controlled to prevent any linear displacement of the web with respect to the precise location where the coating application is to be made. A means of controlling the lengthwise variation is provided by nip roller 34 in contact with the impression roller 22 prior to the coating nip 20.

The actuation means can be provided by a variety of devices or apparatus, depending on the mass and rates of engagement and disengagement required. The required rates of engagement and disengagement are specific to a given product as well as the functional operating parameters that accompany the product. The actuation means could be provided by an air jack, hydraulic jack, electromagnetic solenoid, mechanically driven cam, servo motor driven cam, a linear motor, or the like.

The rates of engagement and disengagement have been found critical in achieving good transitions from the uncoated to the coated zone. If the rate of engagement is too slow, the start transition is smeared out over a long distance. If the rate of engagement is too fast, the coating applicator rebounds from its home position causing a disturbance in the coating. The ideal rate of engagement therefore becomes a balance between a smeared start and rebound non-uniformity.

If the rate of disengagement is too slow, smearing again occurs at the trail edge of the patch. If the rate of disengagement is too fast, the liquid bead at the gravure cylinder web interface is coated as a single heavy crossline which affects the ultimate product use and may not dry adequately, possibly causing contamination and ruined product. The ideal disengagement rate is a balance between these two extremes. The ideal engagement and disengagement rates are a function of the coating application parameters such as nip geometry, roll durometer, roll diameters, footprint, engraving patterns, coating volume, web speed, solution viscosity and rheology. The required rates are specific to a given product and operating parameters that accompany the given product.

The examples below show the case for one specific set of conditions in making a patch element for a donor dye ribbon. Other applications could result in a different required rate. All examples below examine coatings of the magenta dye layer of Kodak thermal donor media. The magenta donor consists of a proprietary mixture of dyes, binders, and solvents coated on a polyethylene terephthalate (PET) support base at 8 micron liquid coverage and 42 cps viscosity. The examples below optimize conditions for good coating starts, finishes, and uniformity. These conditions are optimized for the specific process parameters employed in the study only (roll diameters, web speed, gravure cylinder engraving pattern, coating solution viscosity, coating solution surface tension). Changing any of these process parameters will change the optimum approach speeds, but not the overall results.

EXAMPLE 1

Kodak thermal donor media is currently manufactured using the prior art gravure process described above. This example demonstrates the uniformity and transitions at the start and finish boundaries of the coated patch. The donor patch is fully usable within 2 mm of both the start and finish transition of each patch.

EXAMPLE 2

Trial coatings of the magenta donor patch element were made on a pilot coating machine. This example utilizes a manual means of starting and finishing the transition to the coated patch by engaging and disengaging the gravure coating cylinder with the web. This resulted in a coated patch that took several inches of coated material to establish the coating start as well as to terminated the coating at the end of the patch. The extra length of coating is wasteful and not acceptable to include in a customer product roll.

EXAMPLE 3

Trial coatings of the magenta donor patch element were made on a pilot coating machine. This example simply utilizes a cam, attached to the elastomeric impression roll axle, to engage and disengage the coating gravure cylinder with the web as shown in FIG. 1. Variable force springs press the gravure cylinder into the impression roll, and the cam controls the gravure cylinder position. (Note that this setup is suitable for experimentally evaluating coating actuations, but is not suitable for production actuations because the actuations are tied to impression roll revolutions, and would therefore deliver only one repeat length). The cam profile used in this example was a square wave cam, aimed at actuating the fastest possible engagement start and disengagement. Results were not ideal. At the coating transition start, the gravure cylinder rebounded on impact with the impression roll. Under certain conditions the gravure cylinder engagement rebounded far enough to cause a coating break. Under other conditions, while rebounding less, the rebound was still sufficient to disturb the coating thickness. At the coating finish, the impact of the gravure cylinder meeting the square wave cam caused solution to be flung off the gravure cylinder, causing a non-uniform, unacceptably long transition.

EXAMPLE 4

Trial coatings of the magenta donor patch element were made on a pilot coating machine. This example utilizes a means of controlling the cam angle, adjusting it so the velocity of gravure cylinder engagement to web (impression roll) and disengagement varied between 6 and 533 mm per second. In this example it was also learned that the optimum approach speed is different for start transitions than finishes. These rates could be different for a different set of hardware and solution parameters. Results are summarized in the table below.

| Engagement Rate | Effect On Start Transition | Effect On Finish Transition |
|---|---|---|
| 6.35 mm/sec | No rebounded effects, but transition | Severe smearing. No coating line |
| 76.2 mm/sec | Optimum condition for patch coating | Severe smearing. No coating line |
| 177.8 mm/sec | Severe rebound effect | Moderate smearing Minimal coating line |
| 356 mm/sec | Severe rebound effect | Minimal smearing Minimal coating line. |
| 533.4 mm/sec | Severe rebound effect | No smearing. Heavy coating line |

EXAMPLE 5

Examples 1-4 employ a cam to actuate the coatings. These methods are suitable for experimental coatings looking to optimize coating quality. An actual implementation will use an actuator that can be independently controlled to provide any required patch and repeat length without any other process change. The same engagement rate requirement will apply, independent of how the actuation motive force is applied. Such actuators include linear motors, solenoids, air jacks, hydraulic jacks, and servomotor driven cams. But again, the actual process used to actuate the cylinder does not affect the print quality. It has been determined that the quality is controlled solely by the actuation rate.

Examples 1-5 discuss S1 and S2, the speed that the gravure cylinder approaches or separates from the impression roll. It is also important to look at the angle of approach and departure. This angle is defined as:

Arctan (gravure cylinder approach speed/web speed). For sharp starts, a sharper approach angle gives a sharper start, but is limited by a recoil/bounce effect. A small approach angle smears out the start. With too high an approach speed, the cylinder bounces back, causing a coverage change, or in severe cases, an actual skip in coating. In the test system used, the maximum approach speed to prevent noticeable bounce was about 75 mm/sec. This maximum speed is controlled by impression roll durometer, gravure cylinder assembly mass, the amount of footprint, and the positioning mechanism design. Because the approach speed is the actual limiting factor, lower speed coatings will be able to have sharper approach angles and therefore sharper coating starts.

The finish quality is controlled entirely by the separation angle. Small separation angles smeared out the finish. Sharp separation angles result in a heavy density line across the patch trailing edge. The solution bead that forms behind the coating nip suddenly being released causes this line. With a slower separation the solution bead is spread over a longer area and is not noticeable. In the test system used, the optimal separation angle was about 14 degrees.

EXAMPLE 6

The apparatus of example 5 was used to make longer patch coatings. When the patch length exceeds the gravure cylinder circumference, a coverage discontinuity occurs after one gravure cylinder circumference. This discontinuity is a sharp coverage drop of approximately 6 percent, and continues till the end of the coating patch. Coating a patch, then adjusting the skip length to allow for 1, 2, or 3 re-fillings prior to coating the next patch demonstrated that two re-fillings bring the coverage to 99+%, three re-fillings bring the coverage to the full original level.

Coating a patch 75% of the circumferential length and then skipping 50% of the circumferential length produced in a similar discontinuity, resulting from part of the patch having one re-fill and the rest of the patch having two re-fills prior to coating. Thus, both the optimum patch length and the optimum separation length are controlled by the gravure cylinder circumference.

The relationship: Patch length<Gravure cylinder circumference<Skip length between patches, assures that the gravure cells will always be re-filled at least two times before any coating, thus avoiding the discontinuity. This restriction only refers to obtaining optimum coverage uniformity. In applications where a 6% coverage shift is not a concern (in an adhesive subbing layer, for example) the restriction does not apply.

It can now be appreciated that a gravure cylinder patch coating apparatus and method have been presented based on the discovery that the speed of engagement and disengagement of the gravure roller and web is critical and can be determined for a particular operating environment. The method of applying a discrete patch of uniform coating to a moving web comprises: delivering a metered amount of coating solution to a continuously etched gravure cylinder; supporting the moving web with a resilient backing roll; controlling linear web movement; defining a nip area between the gravure roller and backing roller; moving the gravure roller to the nip to a precise lengthwise location on the web; controlling the speed of movement, $S_1$, of the gravure roller to the nip; and controlling the speed of movement, $S_2$, of the gravure roller from the nip thereby producing a discrete patch.

The method may include creating additional patches by repeatedly moving gravure roller to and from the nip. The method includes bringing the gravure roller into and maintaining contact with the web by force. $S_1$ and $S_2$ are independent of one another and may be the same value of different values depending on the process parameters. $S_1$ has a magnitude sufficient for creating the patch without smearing the transition, but not sufficient enough to cause rebound. $S_2$ has a magnitude sufficient for creating the patch without smearing the transition, but not sufficient enough to cause an objectionable coating line.

A gravure method for applying a discrete patch of uniform coating to a moving web includes defining a nip area between a gravure roller and a backing roller, moving the gravure roller to the nip to a precise lengthwise location on the web, and moving the gravure roller from the nip. The gravure method is improved by controlling the speed of movement, $S_1$, of the gravure roller to the nip; and controlling the speed of movement, $S_2$, of the gravure roller from the nip thereby producing a discrete patch. $S_1$ has a magnitude sufficient for creating the patch without smearing the transition, but not sufficient enough to cause rebound. $S_2$ has a magnitude sufficient for creating the patch without smearing the transition, but not sufficient enough to cause an objectionable coating line.

The apparatus for applying a discrete patch of uniform coating to a moving web comprises: an etched gravure cylinder; means for delivering a metered amount of coating solution to the gravure cylinder; a resilient backing roll supporting the web, the gravure roller and the backing roller defining a nip area therebetween between; means for controlling linear movement of the web; means for moving the gravure roller to the nip to a precise lengthwise location on the web; means for controlling speed of movement, $S_1$, of the gravure roller to the nip; and means for controlling speed of movement, $S_2$, of the gravure roller from the nip thereby producing a discrete patch. The apparatus includes means for bringing the gravure roller into and maintaining contact with the web by force. $S_1$ and $S_2$ are independent of one another and may be the same or different depending on the process variables. $S_1$ has a magnitude sufficient for creating the patch without smearing a transition area of the patch, but not sufficient enough to cause rebound of the gravure roller from the web. $S_2$ has a magnitude sufficient for creating the patch without smearing a transition area of the patch, but not sufficient enough to cause an objectionable coating line.

Patch start edge quality is governed by the angle of the gravure cylinder approaching the web. The angle is the arctan (gravure cylinder approach speed/web speed). For start sharpness, a higher angle gives a sharper coating start but approach speed is limited by recoil/bounce. For the specific equipment used, the approach speed is limited to about 75 mm/s to prevent bounce. This maximum speed will be controlled by roll durometer, gravure cylinder assembly mass, footprint, and the positioning mechanism. For the apparatus used, the 75 mm/s approach speed and 300 ft/min web speed resulted in an approach angle of 2.86 degrees, which gave sharp start without unacceptable bounce. Slower web speed with the same approach speed results in a sharper angle and therefore an even sharper start. A slower approach speed smears the start.

Patch finish edge quality is governed by the angle of the gravure cylinder departing the web. The angle is the arctan (gravure cylinder separation speed/web speed). A higher separation angle is not necessarily better. Too fast a separation (high separation angle) results in a heavy density line across the patch trailing edge because the coating bead does not have time to dissipate. The coating nip is controlled by viscosity, surface tension, solution coverage and the foot print. For the apparatus used, an approach angle of about 14 degrees gave sharp coating finish without an unacceptable high density line. Slower separation speeds smear the finish.

For the highest quality patch coating, the process works for variable patch lengths but is limited to a length equal to the gravure roll circumference. This limitation exists for the apparatus used because a second revolution of the gravure roller delivers about 6 percent less wet coverage than the first revolution. This means that if the patch length is longer than the gravure roller circumference, there will be an abrupt 6 percent drop in the coated layer. It takes three refillings of the gravure cells to fully return to the original coverage. It takes two refillings of the gravure cells to return to 99+% of the original coverage, which is acceptable. This also means that the uncoated length between patches must be longer than the patch length to assure the gravure cells are refilled two times before coating the next patch.

Figure 7:
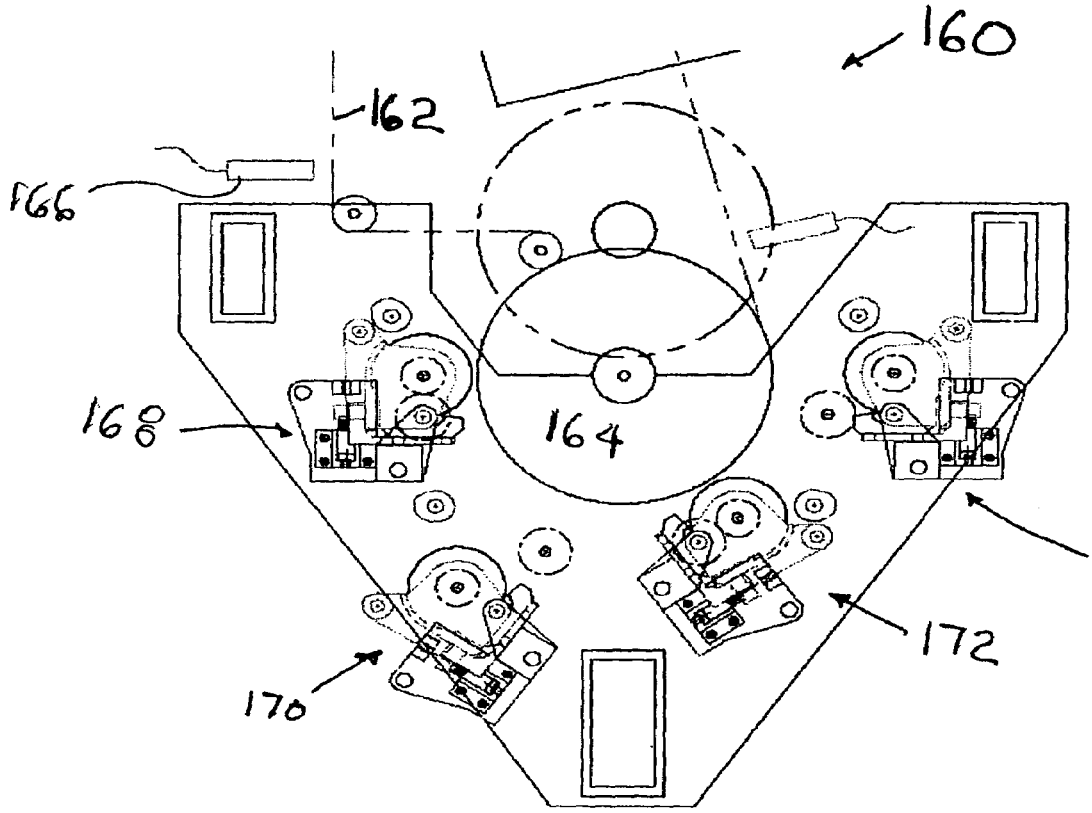
FIG. 7 is a diagram illustrating multiple gravure rollers for applying color patches.

Referring now to FIG. 7, a coating apparatus 160 for coating a traveling web 162 has an impression roller 164 and a number of registration sensors 166. As illustrated, impression roller 164 is a large diameter roller sufficient to entrain thereabout a length of web 162 to which four patches may be applied simultaneously. In the case of thermal printer ribbon, the color patches will typically be cyan, magenta, yellow and a clear or black patch to effect color printing. Gravure roller assemblies 168, 170, 172, 174 are positioned about impression roller 164 and are moved into and out of the nips formed to coat the web. Each gravure roller assembly is the same as the components and mechanisms associated with gravure roller 16 discussed above with reference to FIGS. 1-6. Because all surface contact in the non-coated areas is eliminated, this arrangement also allows coating multiple different color patches without drying each patch prior to applying the next patch. The respective gravure cylinder or coating head only moves in to contact to coat the web at the desired location, and retracts away at the required rate where other colors of the ribbon need to be coated. A potential problem with multiple patches is that when arranging two or more gravure assemblies around a single impression roll and coating multiple patches simultaneously on the same web, there is a possibility of web conveyance problems, resulting in creases, folds, poor tracking, or tension loss. The equipment tested demonstrated good conveyance and produced high quality thermal ribbon, with the rates of engagement and disengagement described in the table of EXAMPLE 4.

The advantages of a multiple coating station include having a single dryer, a shorter ribbon path and easier patch-to-patch registration. A single dryer reduces both capital investment and operating costs. A shorter ribbon path requires fewer rollers, fewer machine frames and fewer steering devices which improves conveyance, etc. Patch-to-patch registration is easier because the distance from point to point on the impression roll is fixed and the web is constrained, not experiencing any elongation or contraction.

The invention has been described in detail with particular reference to certain preferred embodiments thereof, but it will be understood that variations and modifications can be made without departing from the invention. For example, other coating application devices may include a slot die coater, slide coater, curtain coater, roller coating applicator, spray coating, jet coating, and reverse gravure. These devices may be chosen, depending on the coverage (thickness) and coating application speed requirements; although the rates of movement to and from the nip described above for the gravure roller may have to be adjusted for these devices. Also, the doctor blade could be modified to better fill the cells in one revolution, or the out of contact speed of the gravure roller could be increased to shorten the uncoated length between patches and thereby conserve material. It is accordingly intended that the claims shall cover all such modifications and applications as do not depart from the true spirit and scope of the invention.

PARTS LIST

10 gravure coating apparatus
12 discrete patch of coating
14 moving web
16 continuously engraved gravure cylinder/roller
18 enclosed chamber blade holder
20 nip
22 impression roller
24 eccentric cam
26 cam follower
28 adjustable spring
30 pivot arm
32 pivot point
34 nip roller
36 actuator
38 electronic control
40 proximity sensor
42 voltage to current converter
44 analog output module
46 multi-channel data acquisition module
48 single digital timing patterns—software programmed
50 digital pattern buffer
52 digital pattern output module
54 counter
56 voltage waveform—software programmed voltage and timing values
140 proximity sensor
144 analog output module
146 multi-channel data acquisition module
148 continuously-supplied digital timing patterns—software programmed
150 digital pattern buffer
152 digital pattern output module
154 counter
156 voltage waveform—software programmed voltage and timing values
158 encoder
160 coating apparatus
162 traveling web
164 impression roller
166 registration sensors
168 gravure roller assembly
170 gravure roller assembly
172 gravure roller assembly
174 gravure roller assembly

The invention claimed is:

1. A method of applying a discrete patch of uniform coating to a moving web, comprising the steps of:

delivering a metered amount of coating solution to a continuously etched gravure cylinder roller;

supporting the moving web with a resilient backing roller;

controlling linear web movement;

defining a nip area between the gravure roller and backing roller;

moving the gravure roller into the nip area at a precise lengthwise location on the web, bringing the gravure roller into and maintaining contact with the web by force;

moving the gravure roller away from the nip area and taking the gravure roller out of contact with the web:

controlling the speed of movement, $S_1$, of the gravure roller into the nip area; and controlling the speed of movement, $S_2$, of the gravure roller away from the nip area thereby producing a discrete patch.

2. The method of claim 1 including creating additional patches by repeatedly moving the gravure roller into and away from the nip area, thereby repeatedly bringing the gravure roller into and out of contact with the web.

3. The method of claim 1 wherein $S_1$ and $S_2$ are different.

4. The method of claim 1 wherein said gravure roller moves away from said nip area at a separation angle of about 14 degrees, where the separation angle is defined as arctan (gravure roller approach speed/web speed).

5. The method of claim 1 wherein $S_1$ has a magnitude sufficient for creating the patch without smearing the transition, but not sufficient enough to cause rebound.

6. The method of claim 1 wherein $S_2$ has a magnitude sufficient for creating the patch without smearing the transition, but not sufficient enough to cause an objectionable coating line.

7. In a gravure method for applying a discrete patch of uniform coating to a moving web including defining a nip area between a gravure roller and a backing roller, moving the gravure roller into the nip area at a precise lengthwise location on the web, bringing the gravure roller into and maintaining contact with the web by force, and moving the gravure roller away from the nip area and taking the gravure roller out of contact with the web, the improvement comprising the steps of:

controlling the speed of movement, $S_1$, of the gravure roller into the nip area; and controlling the speed of movement, $S_2$, of the gravure roller away from the nip area thereby producing a discrete patch.

8. The method of claim 7 wherein $S_1$ and $S_2$ are different.

9. The method of claim 7 wherein said gravure roller moves away from said nip area at a separation angle of about 14 degrees, where the separation angle is defined as arctan (gravure roller approach speed/web speed).

10. The method of claim 7 wherein $S_1$ has a magnitude sufficient for creating the patch without smearing the transition, but not sufficient enough to cause rebound.

11. The method of claim 7 wherein $S_2$ has a magnitude sufficient for creating the patch without smearing the transition, but not sufficient enough to cause an objectionable coating line.

* * * * *